US006194677B1

(12) United States Patent
Li

(10) Patent No.: US 6,194,677 B1
(45) Date of Patent: Feb. 27, 2001

(54) STRUCTURE OF KEYSWITCH

(75) Inventor: Tung Hsueh Li, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/460,403

(22) Filed: Dec. 13, 1999

(51) Int. Cl.[7] ..... H01K 13/70
(52) U.S. Cl. ..... 200/344
(58) Field of Search ..... 200/5 A, 517, 200/344, 345; 400/472, 490, 491, 491.2, 495, 495.1, 496

(56) References Cited

U.S. PATENT DOCUMENTS

| | | | | |
|---|---|---|---|---|
| 5,763,842 | * | 6/1998 | Tsai et al. | 200/5 A |
| 5,964,341 | * | 10/1999 | Tsai | 200/344 |
| 5,994,655 | * | 11/1999 | Tsai | 200/344 |
| 6,011,227 | * | 1/2000 | Yoneyama | 200/344 |
| 6,040,540 | * | 3/2000 | Tsai et al. | 200/344 |
| 6,040,541 | * | 3/2000 | Li | 200/344 |

* cited by examiner

*Primary Examiner*—Michael Friedhofer
(74) *Attorney, Agent, or Firm*—Rosenberg, Klein & Lee

(57) ABSTRACT

An improved structure of keyswitch comprises a circuit base with a circuit layer, a resilient dome, a supporting lever and a keytop. The circuit base further comprises a substrate and a flexible circuit layer. T supporting lever comprising a first lever and a second lever pivotal to each other in scissors arrangement. The first lever has a sliding portion on bottom side thereof and the second lever has a rotating portion on bottom side thereof and a sliding portion on top side thereof. The sliding portion of the first lever comprises two clamping blocks and a sliding shaft arranged between the two clamping blocks. The clamping block is extended from the sliding shaft such that the edge at the intersection of an outer surface of the sliding shaft and an bottom surface of the sliding shaft is an embowed square shape. The sliding shaft is entirely or partially embedded into the first through hole. The rotational portion of the second lever has two rotational shafts retained between the second retaining bodies and embedded within the second through hole. Therefore, the height of the keyswitch is lowered and the key pressing operation is more stable.

18 Claims, 6 Drawing Sheets

STRUCTURE OF KEYSWITCH

FIELD OF THE INVENTION

The present invention relates to an improved structure of keyswitch, especially to a keyswitch, which has lower profile and stable key pressing stroke while the stroke length is not defectively deduced.

BACKGROUND OF THE INVENTION

As shown in FIG. 1, the conventional keyswitch 1 for notebook computer at least comprises a substrate 10, a flexible circuit layer 11, a resilient dome 12, a supporting lever 13 and a keytop 14. The substrate 10 is provided with a first retaining hook 100, a second retaining hook 101, a first through hole 102 and a second through hole 103. The flexible circuit layer 11 and the resilient dome 12 are respectively stacked on the substrate 10. The supporting lever 13 comprises a first lever 130 and a second lever 131 pivotal to each other in scissors arrangement. The first lever 130 comprises a rounded sliding shaft 132 on bottom side thereof and slidable within the first retaining hook 100. The top of the first lever 130 is pivotally connected to the keytop 14. The second lever 131 comprises a rounded rotating shaft 133 on bottom side thereof and rotatable within the second retaining hook 101. The top of the second lever 130 is slidably connected to the keytop 14. The keytop 14 can be lowered to strike the resilient dome 12 by the rotating movement of the rotating shaft 133 and the sliding movement of the sliding shaft 132. The resilient dome 12 is collapsed to turn on the corresponding switch on the flexible circuit layer 11 and generate associate keyswitch signal.

However, in above-mentioned keyswitch 1, both the rotating shaft 133 and the sliding shaft 132 lay against the substrate 10 at location beside the though holes 102 and 103, or against the flexible circuit layer 11 upon the substrate 10. Therefore, the first retaining hook 100 and the second retaining hook 101 have abrupt-raising height to accommodate the rotating shaft 133 and the sliding shaft 132. The whole supporting lever 13 is forced to place upon the flexible circuit layer 11 and the height of the keytop 14 relative to the flexible circuit layer 11 can not be reduced. Moreover, the supporting lever 13 is in contact with the flexible circuit layer 11 or the substrate 10 by the tangential portion of the rotating shaft 133 and the sliding shaft 132, the stability of the supporting lever 13 is poor. The supporting lever 13 may shake when the keytop 14 is pressed.

To overcome above problem, an improved structure of keyswitch is provided and comprises a circuit base with a circuit layer, a resilient dome, a supporting lever and a keytop. The circuit base further comprises a substrate and a flexible circuit layer. T supporting lever comprising a first lever and a second lever pivotal to each other in scissors arrangement. The first lever has a sliding portion on bottom side thereof and the second lever has a rotating portion on bottom side thereof and a sliding portion on top side thereof. The sliding portion of the first lever comprises two clamping blocks and a sliding shaft arranged between the two clamping blocks. The clamping block is extended from the sliding shaft such that the edge at the intersection of an outer surface of the sliding shaft and an bottom surface of the sliding shaft is an embowed square shape. The sliding shaft is entirely or partially embedded into the first through hole. The rotational portion of the second lever has two rotational shafts retained between the second retaining bodies and embedded within the second through hole. Therefore, the height of the keyswitch is lowered and the key pressing operation is more stable.

The various objects and advantages of the present invention will be more readily understood from the following detailed description when read in conjunction with the appended drawing, in which:

DETAILED DESCRIPTION OF THE PREFERRED EMBODIMENT

Figure 1:
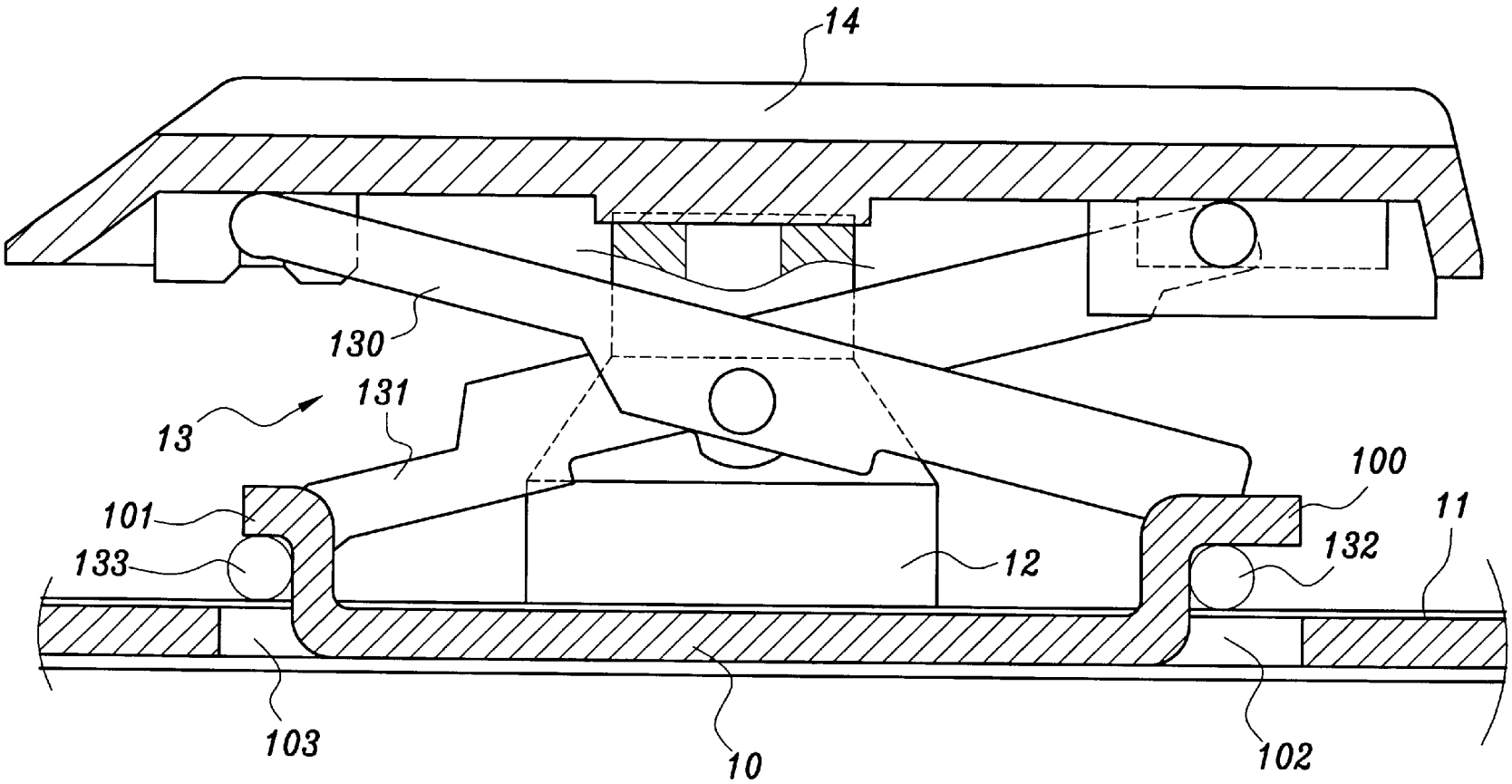
FIG.1 PRIOR ART
FIG. 1 is the sectional view of a conventional keyswitch.
Figure 2:
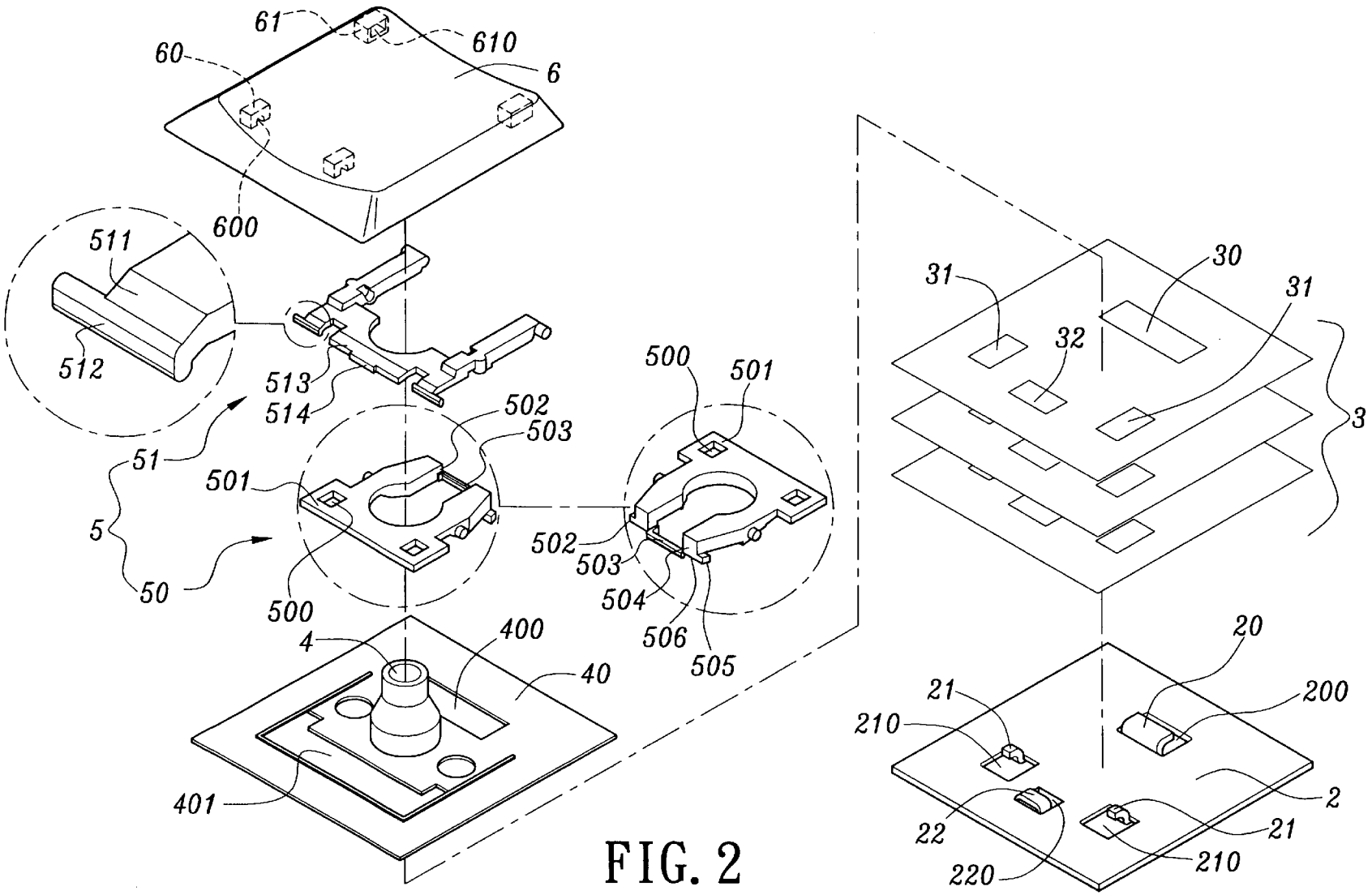
FIG. 2 is the exploded view of the present invention.
Figure 3:
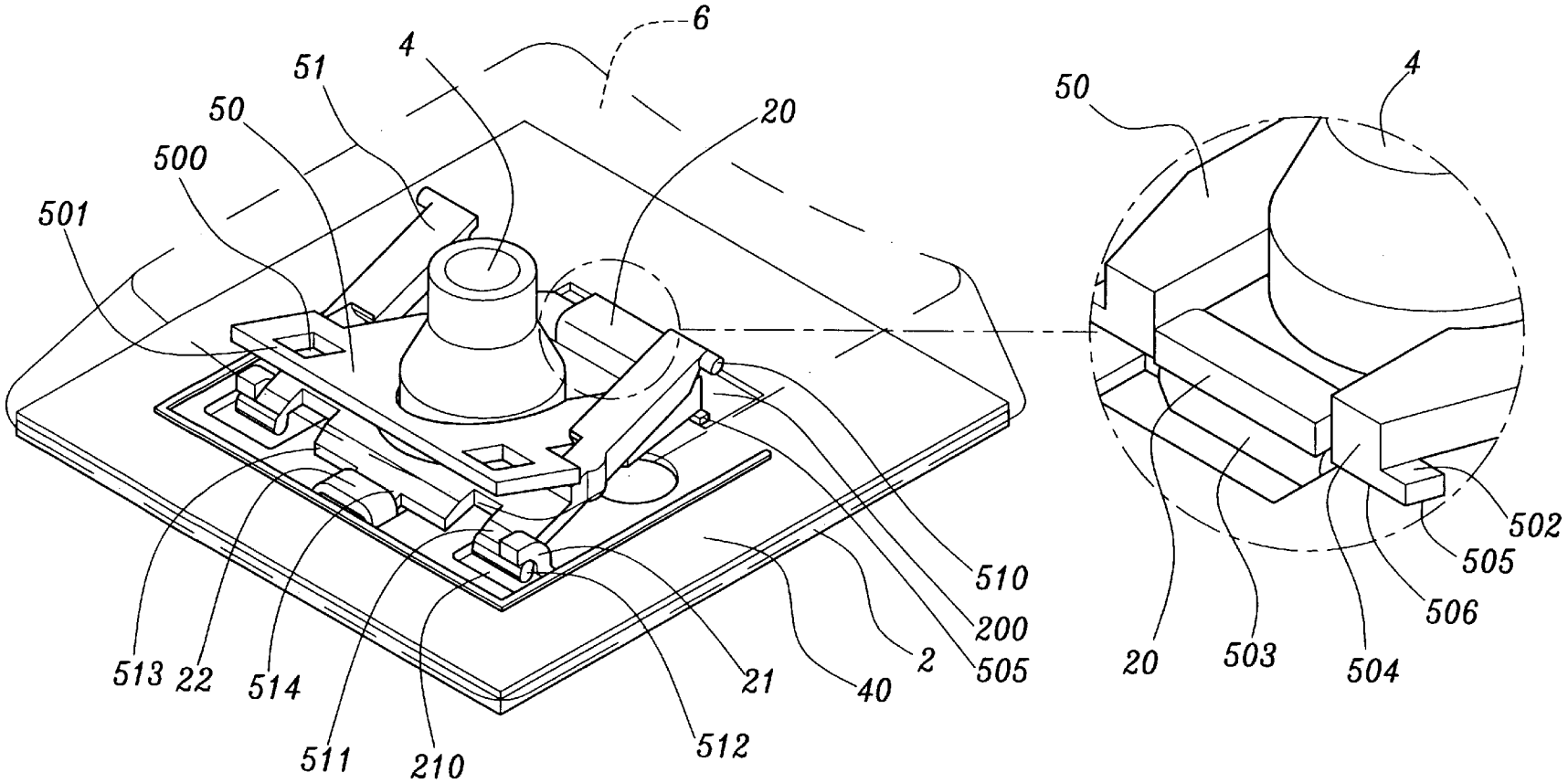
FIG. 3 is the perspective view of the present invention.

With reference now to FIGS. 2 and 3, the present invention is intended to provide an improved keyswitch with enhanced keyswitch stability. The inventive keyswitch structure comprises a circuit base with a circuit layer, a resilient dome 4, a supporting lever 5 and a keytop 6. In the preferred embodiment of the present invention, the circuit base further comprises a substrate 2 and a flexible circuit layer 3.

The substrate 2 is provided with an inverted L-shaped first retaining hook 20 and two second inverted L-shaped retaining hooks 21 arranged roughly in triangular form. The substrate 2 is further provided with a first through hole 200 below the hook portion of the first retaining hook 20 and two second through holes 210 below the hook portion of the second retaining hook 21. A blocking plate 22 is provided at a location outer to the middle point between two second through holes 210. A third through hole 220 is provided at a location inner to the blocking plate 22.

The flexible circuit layer 3 is arranged upon the substrate 2 and has electrical contact which is turned on once being pressed. The flexible circuit layer 3 further comprises a plurality of through holes 30, 31, 32 corresponding to the retaining hooks 20 and 21 and the blocking plate 22. The flexible circuit layer 3 can be a single-layer flexible circuit, a double-layer flexible circuit or a double-layer flexible circuit separated by a spacer as shown in FIG. 2.

The resilient dome 4 is individually arranged on the flexible circuit layer 3 or firstly mounted on a pad 40 with aperture 400 and 401 and then mounted on the flexible circuit layer 3.

The supporting lever 5 comprises a first lever 50 and a second lever 51 pivotal to each other in scissors arrangement. The first lever 50 has a sliding portion on bottom side thereof, which is retained by the first retaining hook 20 and can slide forward and backward, and a rotating portion on top side thereof, which is rotating shaft 501 defined by the hole 500 and the front edge of the first lever 50. The second lever 51 comprises a rotating portion on bottom side thereof, which is retained by the second retaining hook 21, and a sliding portion on top side thereof, which is sliding shaft 510 extended from two lateral sides of the second lever 51.

The keytop 6 has two U-shaped retaining plates 60 each with a pivot groove 600 and located on two bottom lateral sides thereof, and two U-shaped retaining plates 61 each with a sliding groove 610 on two bottom lateral sides thereof. Therefore, the rotating shaft 501 of the first lever 51 is retained by and rotates within the pivot groove 600 and the sliding shaft 510 of the second lever 51 is retained by and slides within the sliding groove 610.

Figure 4:
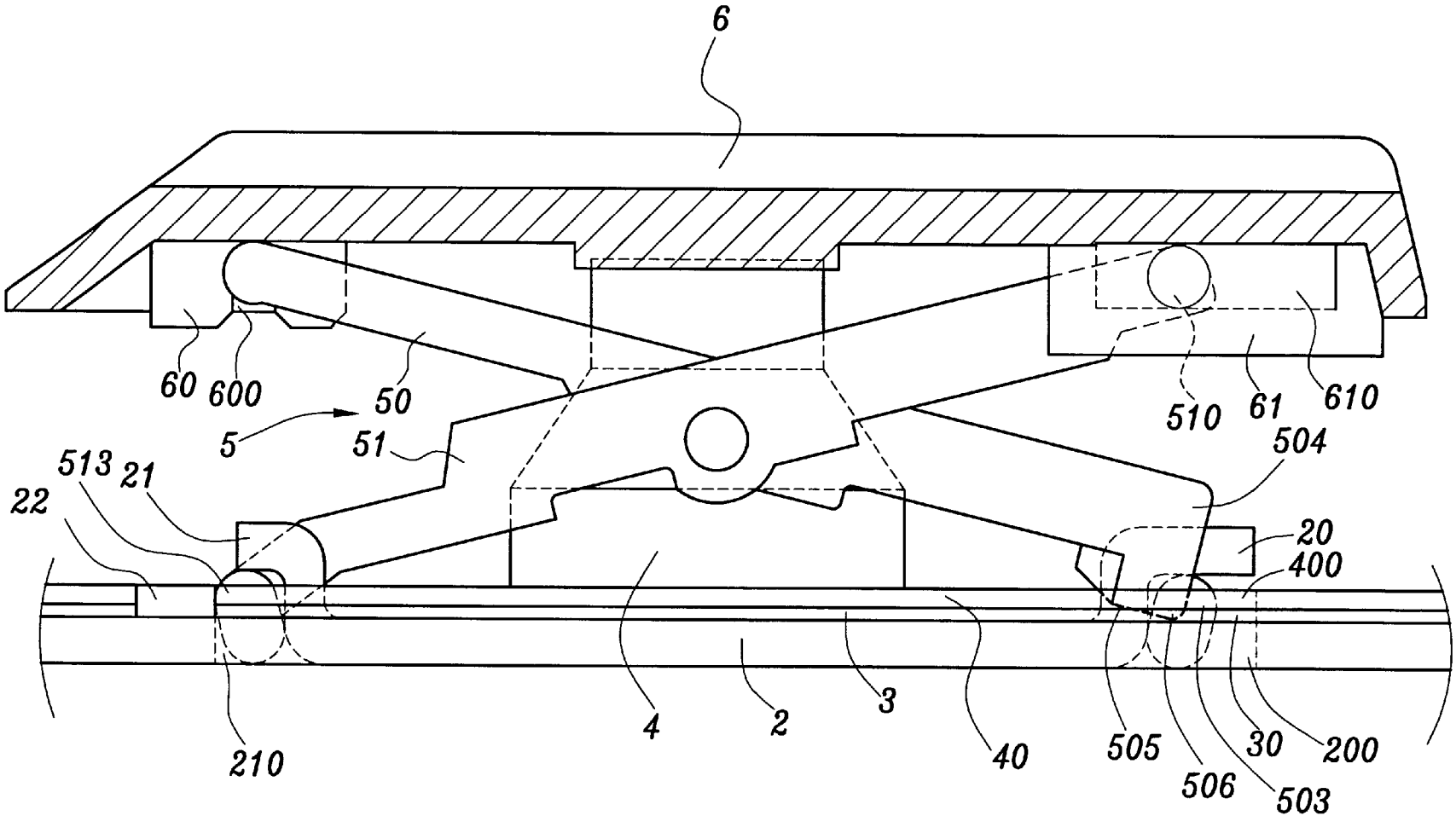
FIG. 4 is a sectional view showing the inventive keyswitch is in a state of not being pressed.

It should be noted that the sliding portion of the first lever 50 comprises two clamping blocks 502 and a sliding shaft 503 arranged between the two clamping blocks 502. Moreover, the cross section of the sliding shaft 503 is preferably an elliptical-like shape as shown in FIG. 4, or simply circular shape or other shapes. The clamping block 502 is extended from a quadrant of the elliptical-like sliding shaft 503 such that the edge 506 at the intersection of the outer surface 504 of the clamping block 502 and the bottom surface 505 of the clamping block 502 is an embowed square shape. More generally, the clamping block 502 is such shaped that it is extended from the elliptical-like sliding shaft 503 and the edge 506 of the clamping block 502 is located at a point on the vertical central line of the elliptical-like sliding shaft 503. No matter what is the adjacent angle between the outer surface 504 of the elliptical-like sliding shaft 503 and the bottom surface 505 of the elliptical-like sliding shaft 503, the clamping block 502 is pressed on the substrate 2 at the edge 506 thereof and rotates with the edge 506 thereof as pivot. The rotational pivot 506 of the clamping block 502 is collinear with the axis of the sliding shaft 503 such that the clamping block 502 is stably slid on the substrate 2. Moreover, the sliding shaft 503 located between two clamping blocks 502 is a U-shape dent with respect to the two clamping blocks 502 as shown in FIGS. 3 and 4. Therefore, the sliding shaft 503 can be hooked by the first retaining hooks 20 and entirely or partially embedded into the first through hole 200.

Moreover, the rotational portion of the second lever 51 comprises a downward-extended deflection portion 511 and two rotational shafts 512 extended from the deflection portion 511. The cross section of the rotational shafts 512 is similar to that of the sliding shaft 503, i.e., an elliptical like shape such that the rotational shafts 512 is retained between the second retaining hooks 21 and the and entirely or partially embedded into the second through hole 210 as shown in FIGS. 3 and 4. Moreover, the second lever 51 has a blocking portion 513 formed between two rotational shafts 512 and pressed on the inner side of the blocking plate 22. The blocking portion 513 further comprises a tongue 514 extended from the central portion thereof and pass through the third through hole 220 to the location below the blocking plate 22 to provide more stability against pulling force.

Figure 5:
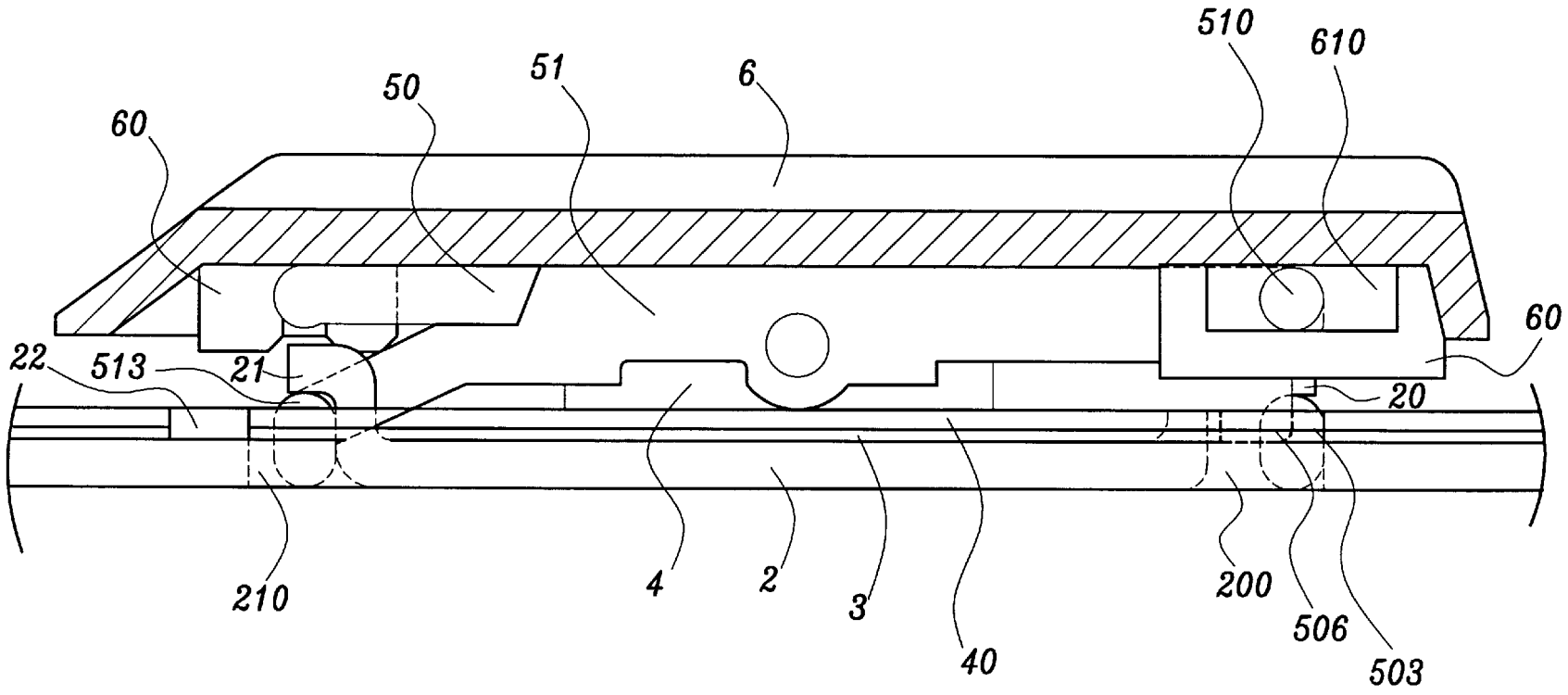
FIG. 5 is a sectional view showing the inventive keyswitch is in a state of being pressed.

As shown in FIGS. 4 and 5, when the keytop 6 is pressed to lower the supporting lever 5, the rotating shaft 501 on top of the first lever 50 is rotated within the pivot groove 600 and the rotational shafts 512 on bottom of the second lever 51 is rotated within the second through hole 210. Moreover, the clamping block 502 on bottom of the first lever 50 is slid within the first retaining hook 20 and the sliding shaft 510 on top of the second lever 51 is slid within the sliding groove 610, thus helping the keyswitch operation. The resilient dome 4 is collapsed to turn on the contact on the flexible circuit layer 3. The sliding shaft 503 of the first lever 50 and the rotational shafts 512 of the second lever 51 are embedded within the first through hole 200 the second through hole 210, respectively. In other word, the supporting lever 5 is not placed on the substrate 2 or the flexible circuit layer 3 as in prior art. The keytop 6 is lowered by a height similar to the thickness of the substrate 2. The projecting height of the retaining hooks 20 and 21 are lowered. The keyswitch is more compact.

Moreover, the first lever 50 is supported by and has linear contact with the edge 506 of the clamping block 502 during sliding, and slide on the substrate 2 with the edge 506 as pivot. The edge 506 is collinear with the axis of the edge 506. The sliding shaft 503 is elliptical-like shape such that it can be more stably supported within the first through hole 200 and the first retaining hook 20. The first lever 50 is more stable during keyswitch. The keytop can be prevented from dropping caused by the rebound of the resilient dome 4 or the over force of the user.

Figure 6:
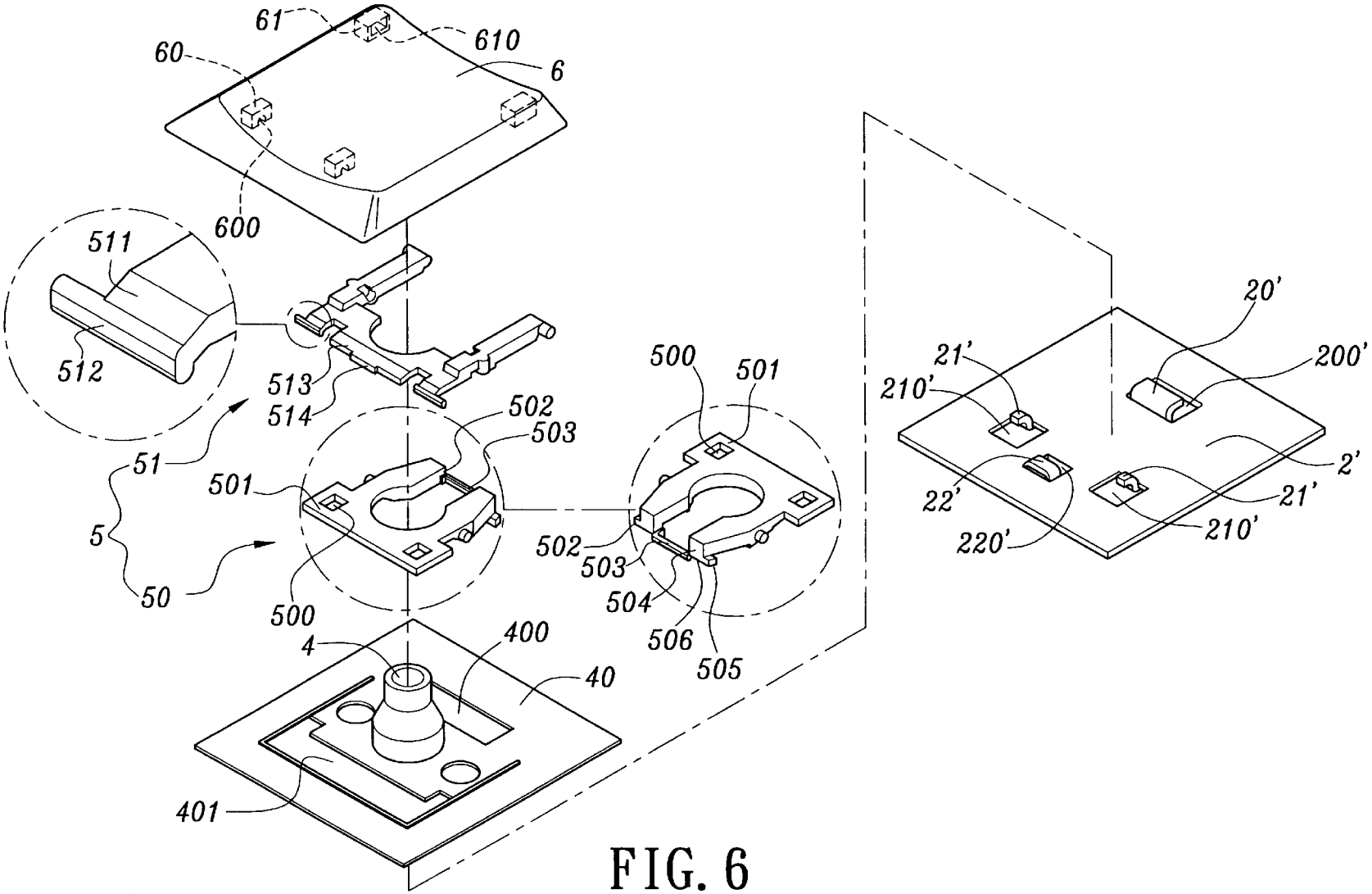
FIG. 6 the exploded view showing the keyswitch according to another preferred embodiment of the present invention.

Moreover, the circuit base shown in FIGS. 2 to 5 comprises a substrate 2 and a flexible circuit layer 3. However, the circuit base can also be a plate shaped circuit board 2' with flexibility and circuit thereon as shown in FIG. 6 The circuit base also has a first retaining hook 20', a second retaining hook 21', a blocking plate 22', a first through hole 200', a second through hole 210' and a third through hole 220' as the substrate 2 in previous embodiment. The height of the entire keyswitch is further reduced.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A keyswitch apparatus comprising:

(a) a keytop having formed thereon at least one first retaining plate and at least one second retaining plate;

(b) a circuit base having formed therein at least one first through hole and at least one second through hole, said circuit base having a first retaining body extending over said at least one first through hole and a second retaining body extending over said at least one second through hole;

(c) a resilient dome disposed over said circuit base for selective electrical coupling thereto; and, (d) a supporting lever assembly for displaceably supporting said keytop over said circuit base and said resilient dome, said supporting lever assembly including:

(1) a first lever having distal sliding and rotating portions, said sliding portion slidably engaging said first retaining body of said circuit base, said rotating portion pivotally engaging said first retaining plate of said keytop, said sliding portion having formed thereon a pair of laterally spaced clamping blocks and a sliding shaft axially extending therebetween, each of said clamping blocks defining outer and bottom surfaces adjoined by a tapered edge extending laterally adjacent an axial direction defined by said sliding shaft, said sliding shaft being disposed in sufficiently recessed manner relative to said clamping blocks to extend into said at least one first through hole of said circuit base; and, (2) a second lever intermediately coupled in pivotal manner to said first lever, said second lever having distal sliding and rotating portions, said second lever sliding portion slidably engaging said second retaining plate of said keytop, said second lever rotating portion having formed thereon a pair of laterally projecting rotational shafts each pivotally engaging said at least one second retaining body of said circuit base, each of said rotational shafts extending into said at least one second through hole of said circuit base.

2. The keyswitch as recited in claim 1 wherein said circuit base includes a substrate and a flexible circuit layer formed thereon, said first and second retaining bodies being formed on said substrate, said flexible circuit layer having formed therein a plurality of openings for passage of said retaining bodies therethrough.

3. The keyswitch as recited in claim 1 wherein said circuit base includes a single plate board having a circuit formed thereon.

4. The keyswitch as recited in claim 1 wherein said sliding shaft of said first lever is elliptical in sectional contour.

5. The keyswitch as recited in claim 4 wherein each of said clamping blocks of said first lever is disposed to transversely overlap approximately an upper sectional quadrant of said sliding shaft, said tapered edge of each of said clamping blocks being disposed in substantially tangential alignment with an axis of said sliding shaft.

6. The keyswitch as recited in claim 1 wherein said tapered edge of each of said clamping blocks is arcuate in contour.

7. The keyswitch as recited in claim 1 wherein said sliding shaft of said first lever is circular in sectional contour.

8. The keyswitch as recited in claim 1 wherein said second lever rotating portion has formed thereon a deflection portion sloping downward to each of said rotational shafts.

9. The keyswitch as recited in claim 1 wherein each of said first and second retaining bodies is formed with a hooked configuration defining substantially an inverted-L sectional contour.

10. The keyswitch as recited in claim 9 wherein said circuit base further includes a blocking plate formed thereon.

11. The keyswitch as recited in claim 10 comprising one said first retaining body and a pair of said second retaining bodies formed respectively on distal portions of said circuit base, said second retaining bodies being laterally spaced one from the other on opposing sides of said blocking plate.

12. The keyswitch as recited in claim 11 wherein said second lever having formed thereon a blocking portion disposed between said rotational shafts for engaging said blocking plate of said circuit base.

13. The keyswitch as recited in claim 12 wherein said circuit base further includes a third through hole adjacent said blocking plate.

14. The keyswitch as recited in claim 13 wherein said blocking portion of said second lever has formed thereon a tongue, said tongue extending into said third through hole.

15. The keyswitch as recited in claim 1 wherein said rotating portion of said first lever has formed therein a pair of apertures adjacent an edge thereof, each of said apertures and said edge defining a rotating shaft.

16. The keyswitch as recited in claim 15 wherein said sliding portion of said second lever has formed thereon a pair of laterally projecting sliding shafts.

17. The keyswitch as recited in claim 16 wherein said first retaining plate of said keytop includes a pair of substantially U-shaped plates for respectively receiving said rotating shafts of said first lever rotating portion in pivotally displaceable manner.

18. The keyswitch as recited in claim 17 wherein said second retaining plate of said keytop includes a pair of plates each having formed therein a sliding groove for receiving one of said sliding shafts of said second lever sliding portion in slidably displaceable manner.

* * * * *